US006959826B2

(12) United States Patent
Knuth et al.

(10) Patent No.: US 6,959,826 B2
(45) Date of Patent: Nov. 1, 2005

(54) RESEALABLE NURSER LINER

(75) Inventors: Rosemary F Knuth, Congers, NY (US); John Rousso, Trumbull, CT (US)

(73) Assignee: Playtex Products, Inc., Westport, CT (US)

( * ) Notice: Subject to any disclaimer, the term of this patent is extended or adjusted under 35 U.S.C. 154(b) by 32 days.

(21) Appl. No.: 10/643,595

(22) Filed: Aug. 19, 2003

(65) Prior Publication Data

US 2005/0040127 A1 Feb. 24, 2005

(51) Int. Cl.[7] ..... A61J 9/00

(52) U.S. Cl. ..... 215/11.1; 215/11.3; 215/11.6; 383/63

(58) Field of Search ..... 215/11.1, 11.3, 215/11.6; 383/63; 604/74, 346

(56) References Cited

U.S. PATENT DOCUMENTS

| | | | | | |
|---|---|---|---|---|---|
| 985,328 | A | * | 2/1911 | Decker | 215/11.6 |
| 2,624,485 | A | | 1/1953 | Boston | |
| 3,161,311 | A | | 12/1964 | Boston | |
| 3,204,855 | A | | 9/1965 | Boynton et al. | |
| 3,645,414 | A | | 2/1972 | Barr | |
| 3,762,542 | A | | 10/1973 | Grimes | |
| 3,790,017 | A | | 2/1974 | Fitzpatrick et al. | |
| 3,822,806 | A | | 7/1974 | Grimes | |
| 3,834,570 | A | | 9/1974 | Barr | |
| 3,871,542 | A | | 3/1975 | Hammer | |
| 4,501,585 | A | | 2/1985 | Friedman | 604/346 |
| 4,600,104 | A | | 7/1986 | Yanase | 206/604 |
| 4,634,006 | A | | 1/1987 | Yanase | 206/604 |
| 4,711,359 | A | * | 12/1987 | White et al. | 215/11.1 |
| 4,787,880 | A | | 11/1988 | Ausnit | 383/638 |
| 4,830,205 | A | | 5/1989 | Hammond et al. | 215/11.3 |
| 4,869,912 | A | | 9/1989 | McCoy et al. | 215/11.3 |
| 5,167,454 | A | | 12/1992 | Woods et al. | 383/35 |
| 5,295,957 | A | * | 3/1994 | Aida et al. | 604/74 |
| 5,356,398 | A | | 10/1994 | Willis | 383/63 |
| 5,385,251 | A | | 1/1995 | Dunn | 215/11.3 |
| 5,509,549 | A | | 4/1996 | Marandola | 215/11.3 |
| D380,271 | S | | 6/1997 | Reinbolt | D24/197 |
| 5,706,961 | A | | 1/1998 | Morano | 215/11.3 |
| D402,196 | S | | 12/1998 | Lynch | |
| D406,348 | S | | 3/1999 | Koehnke | D24/197 |
| 5,894,947 | A | | 4/1999 | Morano | 215/11.3 |
| 6,050,432 | A | | 4/2000 | Koehnke | 215/11.3 |
| 6,110,091 | A | | 8/2000 | Morano | 215/11.3 |
| 6,290,392 | B1 | | 9/2001 | Sandor | 383/33 |
| 6,328,082 | B1 | | 12/2001 | Lafond | 215/11.3 |
| D464,257 | S | | 10/2002 | Gates | D9/305 |
| 6,575,202 | B2 | | 6/2003 | Lafond | 215/11.3 |
| 6,576,278 | B1 | | 6/2003 | Sprehe | 215/11.3 |
| 2002/0033199 | A1 | | 3/2002 | Lafond | 141/10 |
| 2002/0156419 | A1 | * | 10/2002 | Silver et al. | |

FOREIGN PATENT DOCUMENTS

| | | | |
|---|---|---|---|
| CA | 2340851 | | 9/2001 |
| FR | 2 783 512 | A1 | 3/2000 |
| FR | 72783512 | A1 * | 3/2000 |
| JP | 08198279 | | 8/1996 |
| JP | 2001/299905 | | 10/2001 |
| WO | WO 9426231 | | 11/1994 |

* cited by examiner

*Primary Examiner*—Sue A. Weaver
(74) *Attorney, Agent, or Firm*—Ohlandt, Greeley, Ruggiero & Perle, L.L.P.

(57) ABSTRACT

There is provided a nurser liner having a closure member for selectively sealing the liner. The closure member has a size and shape that facilitates engagement with the open upper end of a holder.

57 Claims, 9 Drawing Sheets

RESEALABLE NURSER LINER

BACKGROUND OF THE INVENTION

1. Field of the Invention

The present invention relates generally to liners for nurser bottles. More particularly, the present invention relates to liners that are resealable.

2. Description of the Prior Art

Disposable liners for containing liquids are used with rigid holders to provide a clean, sanitary container for each use, instead of reusable bottles which require regular washing and sometimes give questionable results regarding cleanliness. Typically, a liner is mounted onto a holder by gripping the upper edge of the liner, drawing the edge over an open rim of the holder, and folding the edge downward over the outer surface of the holder. The liner is then filled with a desired liquid, and a cover, such as a nursing nipple, may be attached to the holder to close the mouth of the liner.

To further increase the hygiene associated with the liners, resealable closure members have been incorporated laterally or horizontally across the liners. In U.S. Pat. No. 6,576,278 to Sprehe, a nurser liner is shown having a continuous, elongated, profiled reclosable fastener disposed laterally across the periphery of the top portion of the enclosure area. The width of the Sprehe liner, and hence the length of the closure member, is in proximity to the diameter of the holder. In U.S. Pat. No. 5,385,251 to Dunn, a nurser liner is shown having a sealing member made up of cooperating projection members that are disposed laterally across the periphery of the top portion of the enclosure area. Similar to the Sprehe liner, the Dunn liner has a width, and hence a sealing member length, that is in proximity to the diameter of the holder. The Sprehe patent asserts that the sealing member can be used to assist in retaining the liner on the holder when the open end of the liner is folded back over the open end of the holder.

Such liners suffer from the drawback of being difficult to assemble with the holder. The lack of flexibility across the closure member or fastener, which needs to be pulled over the neck of the holder and the holder threads, and the close proximity of the length of the closure member or fastener compared to the diameter of the holder, make the assembly difficult. Often, the fastener needs to be stretched before it will be folded over the rim. This provides the risk of tearing, as well as requiring more handling of the bag and the added risk of contaminating the bag. Precious breast milk may spill and/or the bag may break from pulling it over the holder neck and threads.

SUMMARY OF THE INVENTION

Against the foregoing background, it is a primary object of the present invention to provide a liner having a closure member that facilitates assembly of the liner with the holder.

It is another object of the present invention to provide such a liner that is easily manipulated.

It is yet another object of the present invention to provide such a liner with a resealable member that is easily manipulated.

It is still another object of the present invention to provide such a liner with tabs that improve gripping during opening and mounting of the liner.

These and other objects and advantages of the present invention are provided by a flexible liner for storage of liquid for feeding of an infant. The liner has an enclosure and a closure member. The enclosure has a sealed periphery except for an opening. The enclosure defines an inner volume for storage of the liquid. The closure member is resealable and traverses the opening for providing selective access to the inner volume. The closure member has a non-linear shape.

The present invention is also provided by an infant feeding assembly that has a flexible liner and a holder. The liner has an enclosure and a closure member. The enclosure has an opening and defines a first volume. The closure member is resealable and traverses the opening for providing selective access to the first volume. The holder has an open end and defines a second volume. The liner is disposed in the second volume. The closure member has a non-linear shape.

The present invention is also provided by an infant feeding assembly that has a flexible liner and a holder. The liner has an enclosure and a closure member. The enclosure has an opening and defines a first volume. The closure member is resealable and traverses the opening. The closure member is movable between first and second positions. The first position allows access through the opening. The second position seals the opening. The closure member has an inner cross-sectional area when in the first position. The holder has an open end with an outer cross-sectional area. The holder defines a second volume. The flexible liner is disposed in the second volume. The inner cross-sectional area is greater than the outer cross-sectional area so that the closure member can slide past the open end.

The present invention is also provided by a nurser liner for use with a holder having an opening. The liner has a liner body, a rim and a closure member. The liner body has an upper portion with an open end. The liner body defines an inner volume. The rim is disposed on the upper portion and extends outwardly from the liner body. The rim is selectively engageable with the holder opening. The closure member is selectively resealable and traverses the open end of the liner body for providing selective access to the inner volume.

The present invention is also provided by an infant feeding assembly that has a nurser liner and a holder. The nurser liner has a liner body, a rim and a closure member. The liner body has an upper portion with an open end. The liner body defines a first volume. The rim is disposed on the upper portion and extends outwardly from the liner body. The holder has an opening and defines a second volume. The closure member is selectively resealable and traverses the open end of the liner body for providing selective access to the first volume. The rim selectively engages with the holder opening for disposing the nurser liner in the second volume.

The closure member can have a semi-circular shape. The semi-circular shape can be upwardly convex. The closure member can also have a V-like shape. The V-like shape can be inverted. In either embodiment, the enclosure can have first and second panels with the same size and shape. The first and second panels can be heat-sealed along the sealed periphery. The flexible liner can have an identification area for identifying the liquid. The closure member can partially define the identification area.

The first and second panels can have a substantially rectangular shape. The first panel can have a first tab. The second panel can have a second tab. The first and second tabs can be perforated for removal. Each of the first and second tabs can have a textured surface and a non-textured surface. The flexible liner can have a gusset. The closure member can have a plurality of projection members.

The liner rim has an upper surface and the closure member can be disposed along that upper surface. The closure member can be disposed along an inner portion of the upper surface of the liner rim. The nurser liner and/or the liner body can be elongated and can also have a substantially cylindrical shape.

BRIEF DESCRIPTION OF THE DRAWINGS

The foregoing, and still further objects and advantages of the present invention, will be more apparent from the following detailed explanation of the preferred embodiments of the invention in connection with the accompanying drawings.

DESCRIPTION OF THE INVENTION

Figure 1:
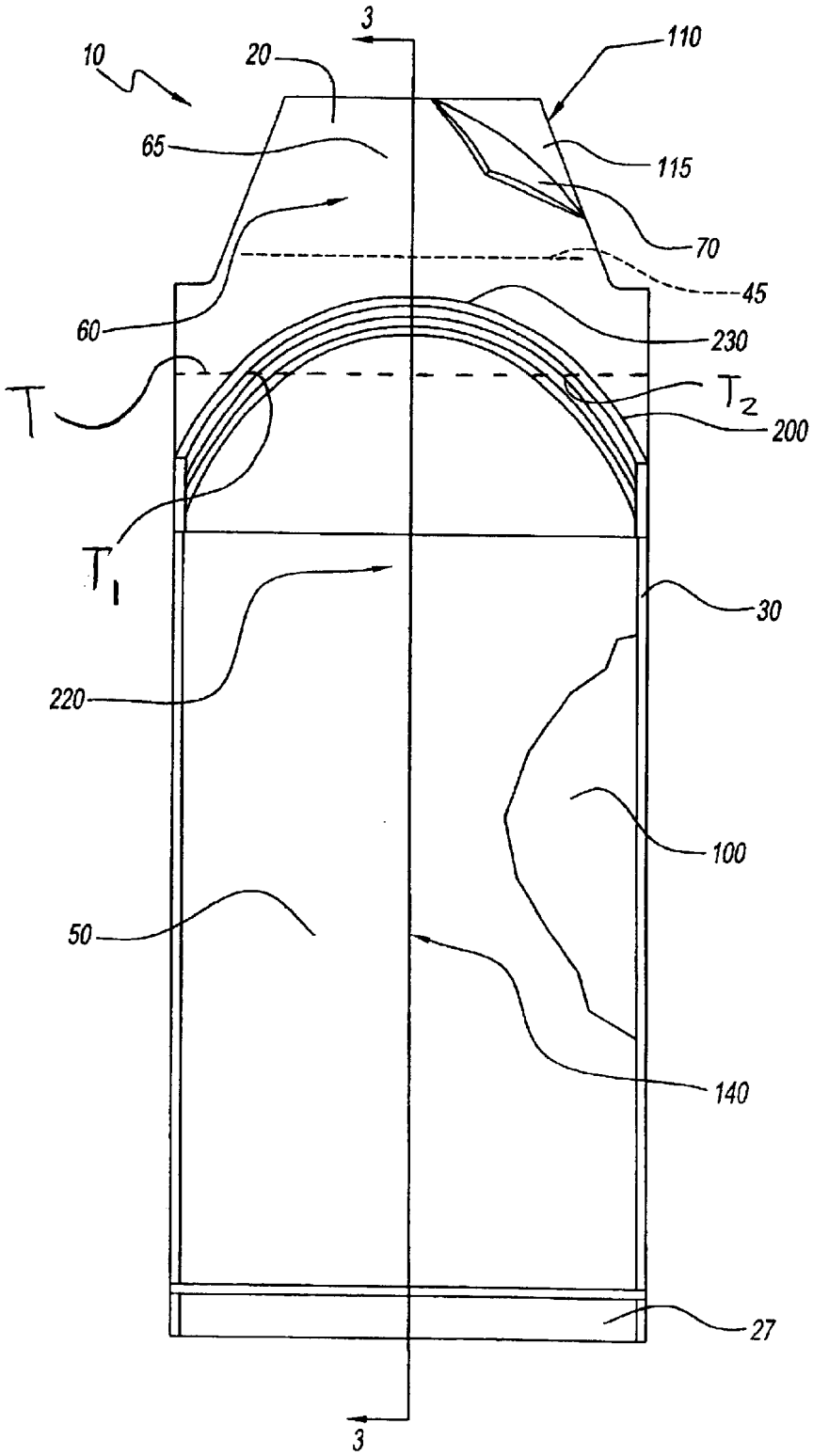
FIG. 1 is a plan view of a flexible liner of the present invention.

Referring to the drawings and, in particular, to FIG. 1, there is provided a liner of the preferred embodiment, which is generally represented by reference numeral 10. The liner 10, preferably, has a collapsed or flattened rectangular shape and can be manipulated into a tubular or cylindrical shape by expanding the inner volume of the liner. It should be understood that throughout the description like reference numerals are used to denote similar features among different embodiments.

The liner 10 has upper and lower ends 20, 25. The liner 10 is preferably formed by a first panel 50 and a second panel 100. First and second panels 50, 100 are connected along a periphery 30 of the liner 10, except at upper end 20, to form a sealable enclosure 40. However, enclosure 40 can be alternatively formed, such as, for example, a tubular sidewall. Preferably, first and second panels 50, 100 are heat-sealed together along the periphery 30 of the panels. However, alternative securing methods can also be used to form enclosure 40, such as, for example, adhesive. Lower end 25 of the liner 10 preferably has a gusset 27 or other type of fold, which provides added strength and facilitates opening of the liner from its collapsed state. Additionally, gusset 27 allows the bag to stand on its own when in an opened state for convenience to the user.

Figure 2:
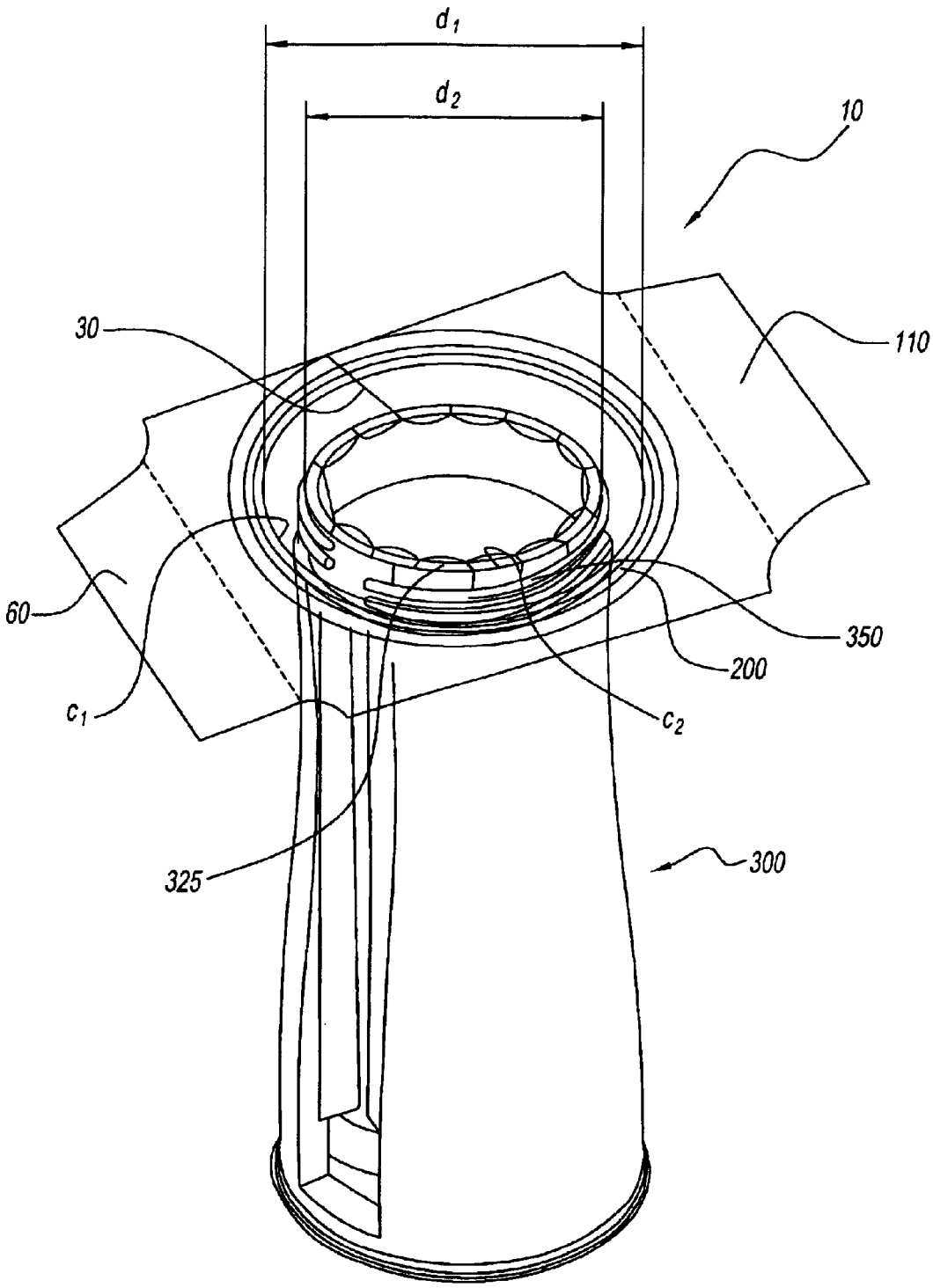
FIG. 2 is a perspective view of the liner of FIG. 1 in an open position and assembled with a holder.

Preferably, first and second panels 50, 100 along upper end 20 have first and second tabs 60, 110, respectively. First and second tabs 60, 110 preferably have a trapezoidal shape such that the left side of the tab is substantially symmetrical to the right side of the tab. First and second tabs 60, 110 preferably each have first, textured surfaces 65, 115 and second, non-textured surfaces 70, 120, which are opposite the first surfaces. In the preferred embodiment, a tab perforation 45 is provided at the base of each tab 60, 110 to facilitate removal of the tabs after the liner 10 has been assembled in a rigid holder 300. The holder 300 has a rim 325 with threads 350 disposed thereon as shown in FIG. 2. An example of a holder usable with liner 10 is disclosed in U.S. application Ser. No. 10/426,902, filed Apr. 30, 2003, which is commonly owned with this pending application. Applicants hereby incorporate by reference the disclosure of that application in its entirety. However, the present invention is usable with other types of holders of varying sizes, shapes and securing structures.

In a preferred embodiment, the first surfaces 65, 115 of tabs 60, 110 are preferably at least partially textured and have a tactile feel, whereas the second surfaces 70, 120 have a non-tactile feel. The textured surface 115 is positioned adjacent a non-textured surface 70 when the liner 10 is in its collapsed or flattened form.

First and second tabs 60, 110 have a plurality of protuberances 75, 125 on their first, textured surfaces 65, 115 and a plurality of penetrated depressions 80, 130 on their second, non-textured surfaces 70, 120. Preferably, the protuberances 125 of second tab 110 correspondingly mate with the depressions 80 on the first tab 60 when the liner 10 is in its collapsed or flattened form. The texture of the first surfaces 65, 115 remains, even when the first and second tabs 60, 110 are separated from each other.

Figure 3:
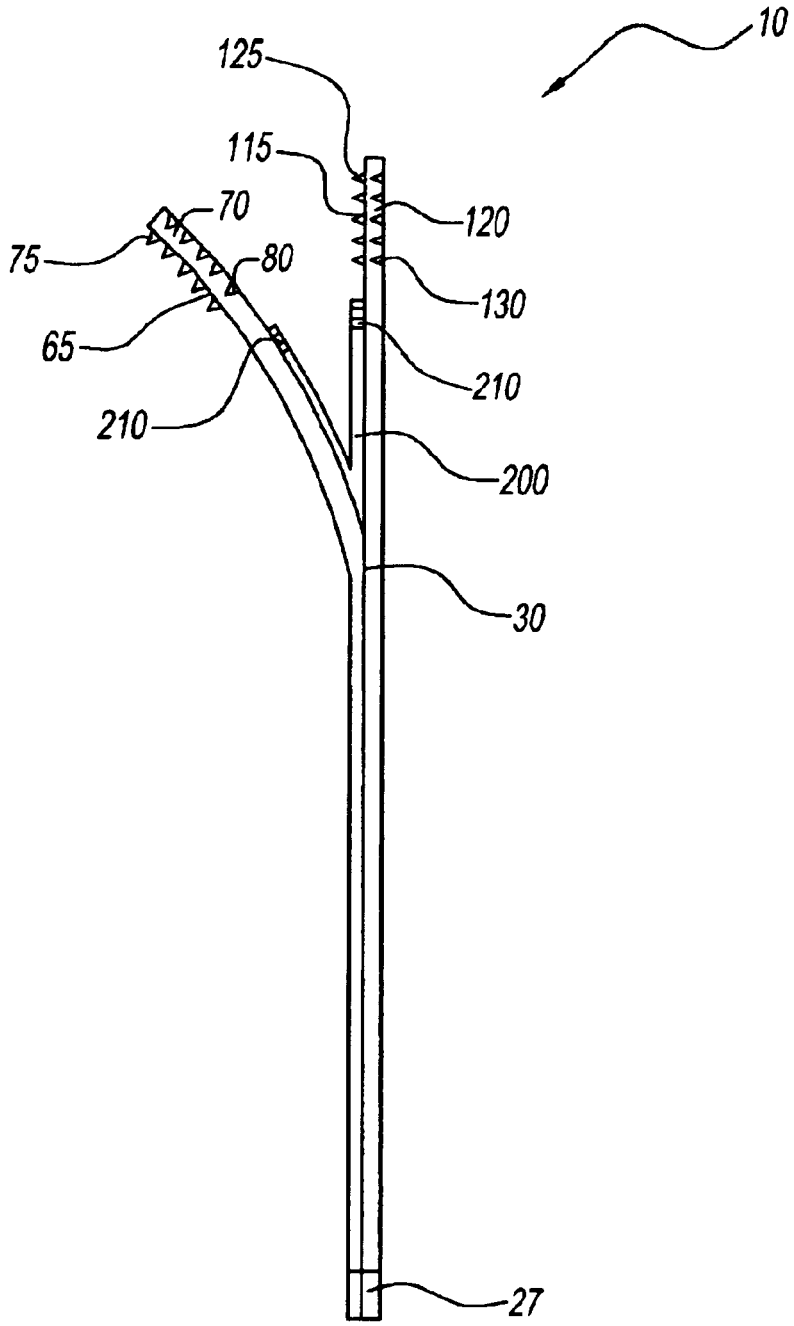
FIG. 3 is a side cross-sectional view of the liner of FIG.1 taken along line 3—3 of FIG. 1.

Referring to FIGS. 1 through 3, liner 10 has a resealable, closure member 200. Closure member 200 allows selective access to the interior volume of enclosure 40 and provides a substantially air-tight seal for the enclosure for the storage of liquids, such as, breast milk. In this embodiment, closure member 200 is a plurality or series of corresponding projection members 210 disposed adjacent to each other, which engage with each other when pressed together. The projection members 210 can have shapes that facilitate the engagement and disengagement of the closure member 200. While the preferred embodiment uses sealing projection members 210, the present invention contemplates the use of alternative resealable closure structures and/or methods, such as, for example, a zipper-type closure. Also, closure member 200 can be heat-sealed into position along first and second panels 50, 100. This heat-sealing can be done at the same time that the first and second panels 50, 100 are heat-sealed along periphery 30.

Closure member 200 has a non-linear shape and traverses upper portion 20 of liner 10. In this embodiment, closure member 200 has an upwardly convex shape that is substantially semi-circular. However, alternative non-linear shapes for closure member 200 can also be used, such as, for example, an elliptical shape or a downwardly concave shape that is substantially semi-circular.

The non-linear shape of closure member 200 provides for a total length of the closure member when in an opened position, which is greater than the total length of the rim 325 (or threads 350 thereon) of the holder 300. As shown in FIG. 2, closure member 200, which has a substantially semi-circular shape when liner 10 is in a collapsed position, has a substantially circular shape when liner 10 is in an open position. Closure member 200 in an open position has a circumference $c_1$ and an inner diameter $d_1$, which is greater than a circumference $c_2$ and an outer diameter $d_2$ of rim 325 (or threads 350) of the holder 300. This facilitates assembly of liner 10 with holder 300 by allowing the closure member 200 to easily pass over the outside of the rim 325 and/or threads 350 of the holder. Preferably, the clearance between the inner portion of closure member 200 and the outer portion of rim 325 or threads 350 is substantial enough so that the user can easily pass the sealing projection 210 over the rim and threads, and so that the closure member does not need to make any contact with the rim or threads. Thus, the closure member 200 does not assist in retaining the liner 10 on the holder 300. Liner 10 can have an inner volume that is substantially equal to the inner volume of holder 300 but without the difficulty of assembling the liner with the holder. The non-linear shape of closure member 200 allows liner 10 to be used with holders 300 having differently-sized open ends, while still maximizing the inner volume of enclosure 40.

The arcuate shape of closure member 200 partially defines an identification area 220 shown in FIG. 1. Identification area 220 allows a user to label the contents of liner 10. Identification area 220 is disposed along liner 10 in a position that is along the enclosure 40 and, in this embodiment, due to the arcuate shape of closure member 200, the area will not be in proximity to the liquid contents of the liner. The positioning of identification area 220 reduces the risk of puncturing the liner 10 and/or contaminating the liquid contents when the user labels the liner.

Closure member 200 has an apex 230. Apex 230 can facilitate handling and manipulation of liner 10 by providing a place for a user to grasp the liner. The arcuate shape of apex 230 facilitates engagement of a user with his or her fingers.

The operation of mounting the liner 10 of the preferred embodiment to rim 325 of rigid holder 300 is shown in FIG. 2. First, the liner 10 is inserted down into the interior of the holder 300 through the rim 325. First tab 60 of the liner 10 is grasped by a thumb and finger of one hand while second tab 110 is, likewise, grasped by the other hand. Next, the first and second tabs 60, 110 are drawn apart to fully open closure member 200. The open upper end 20 of liner 10 is then pulled down over the rim 325 of the holder 300. The liner 10 is drawn downward over the outer periphery of the rim 325 until the closure member 200 passes the threads 350. In the preferred embodiment, the tabs 60, 110 are then pulled and, thus, removed from the liner 10. The liner 10 can then be secured in place by screwing a nipple ring (not shown) to threads 350.

The material for the liner 10 may be any type of thin sheet or film of elastomeric material, such as polyolefin resins and blends, suitable for the features described herein and may be pierced by a cutting tool. The group of polyolefin resins and blends includes low density polyethylene (LDPE), linear low density polyethylene (LLDPE), medium density polyethylene (MDPE), high density polyethylene (HDPE), polypropylene (PP) and ethylene-vinyl acetate (EVA) or other rubber or plastic materials that provide suitable strength in thin walled liner form. The preferred material is a polyethylene resin, and more preferably low density polyethylene. Additionally, a multi-layer material can be used to provide for improved barrier protection for the enclosure 40, such as, for example, to limit the transmission of oxygen through the liner 10 and to absorb UV rays or impede them from transmitting through the liner to the breast milk stored in enclosure 40.

Figure 4:
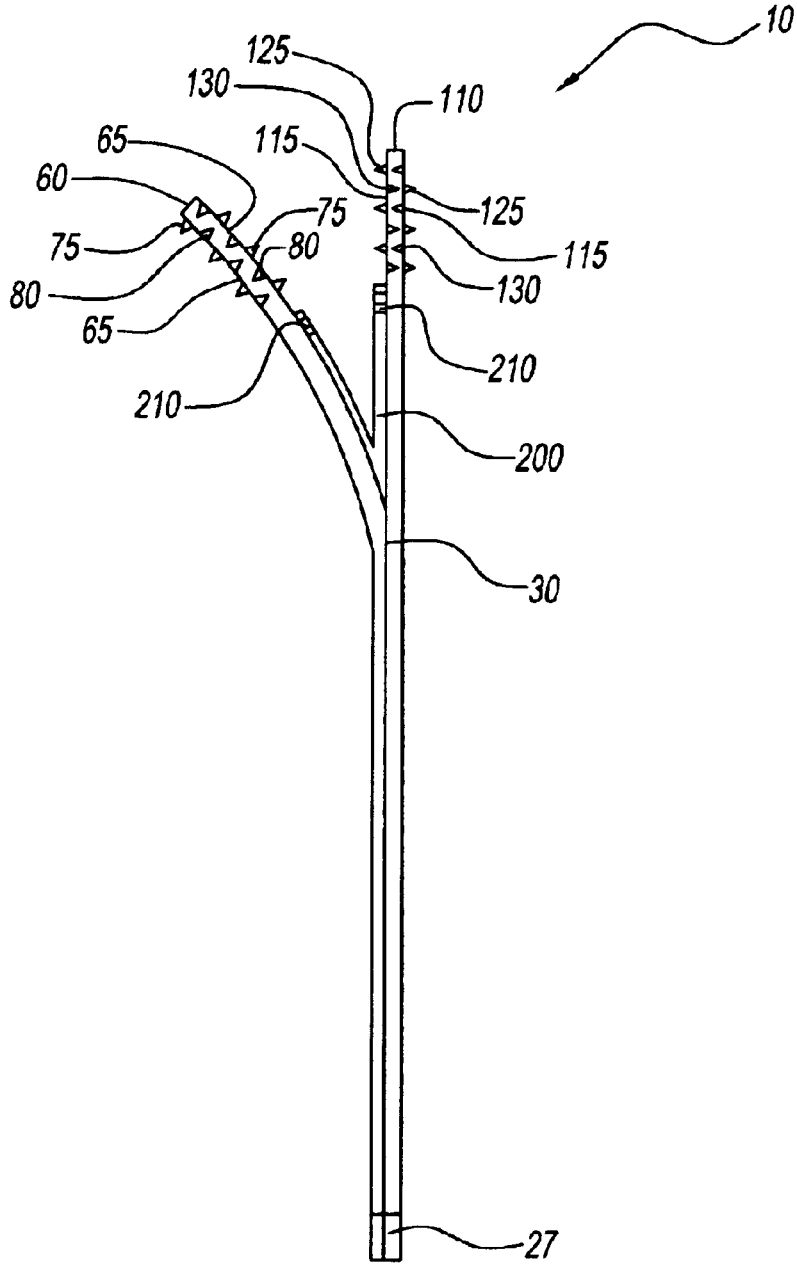
FIG. 4 is a side cross-sectional view of the liner of FIG. 1 taken along line 3—3 of FIG. 1, with an alternative embodiment of the tabs of the present invention.

Referring to FIG. 4, liner 10 is shown with an alternative design for first and second tabs 60, 110. First and second tabs 60, 110 have textured surfaces 65, 115 on opposing sides of each of the tabs. Preferably, textured surfaces 65, 115 are formed by a plurality protuberances 75, 125, respectively. More preferably, first and second tabs have a plurality of penetrated depressions 80, 130 formed on each side of the tabs, respectively.

Figure 5:
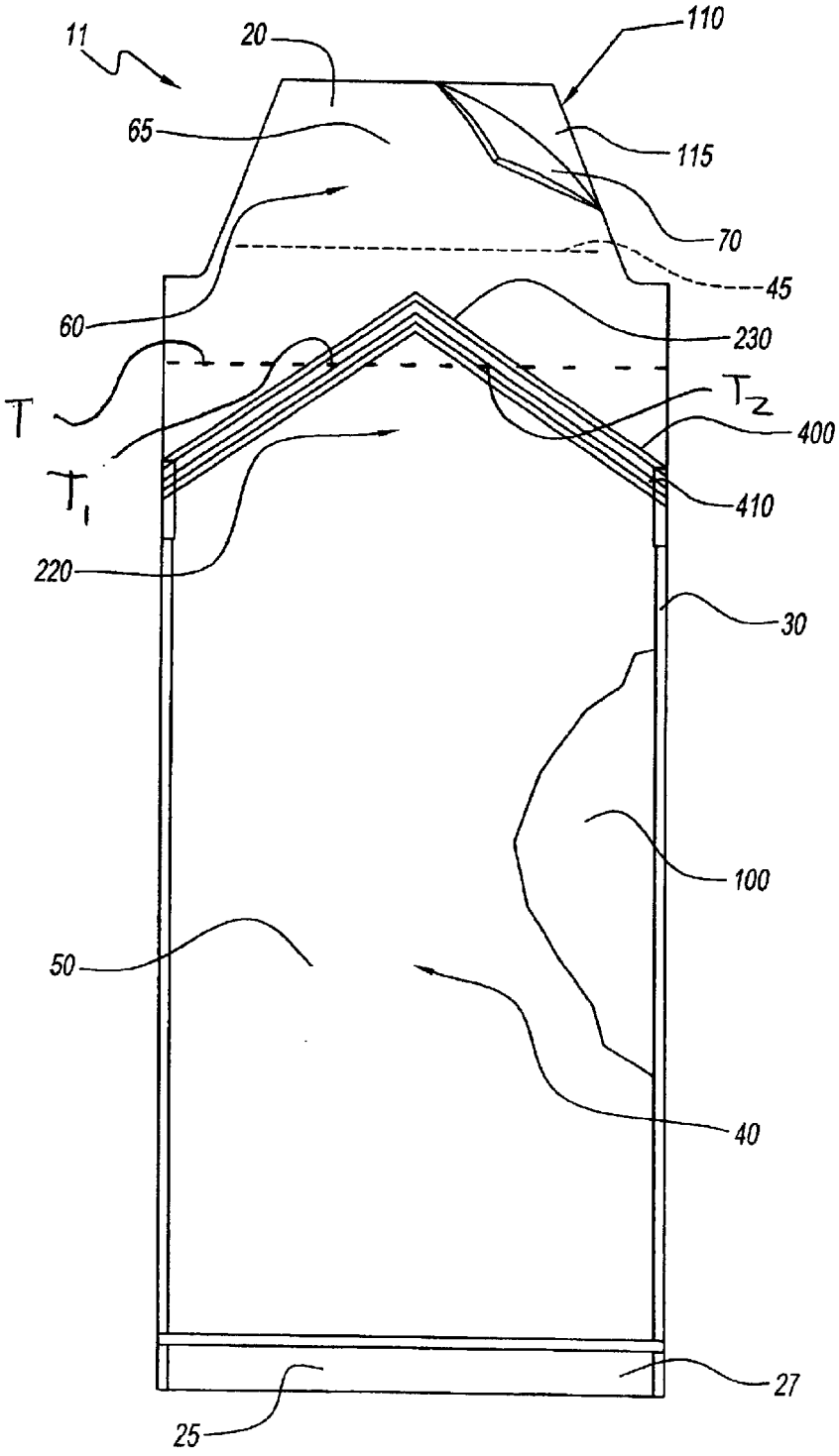
FIG. 5 is a plan view of an alternative embodiment of the liner of the present invention.
Figure 6:
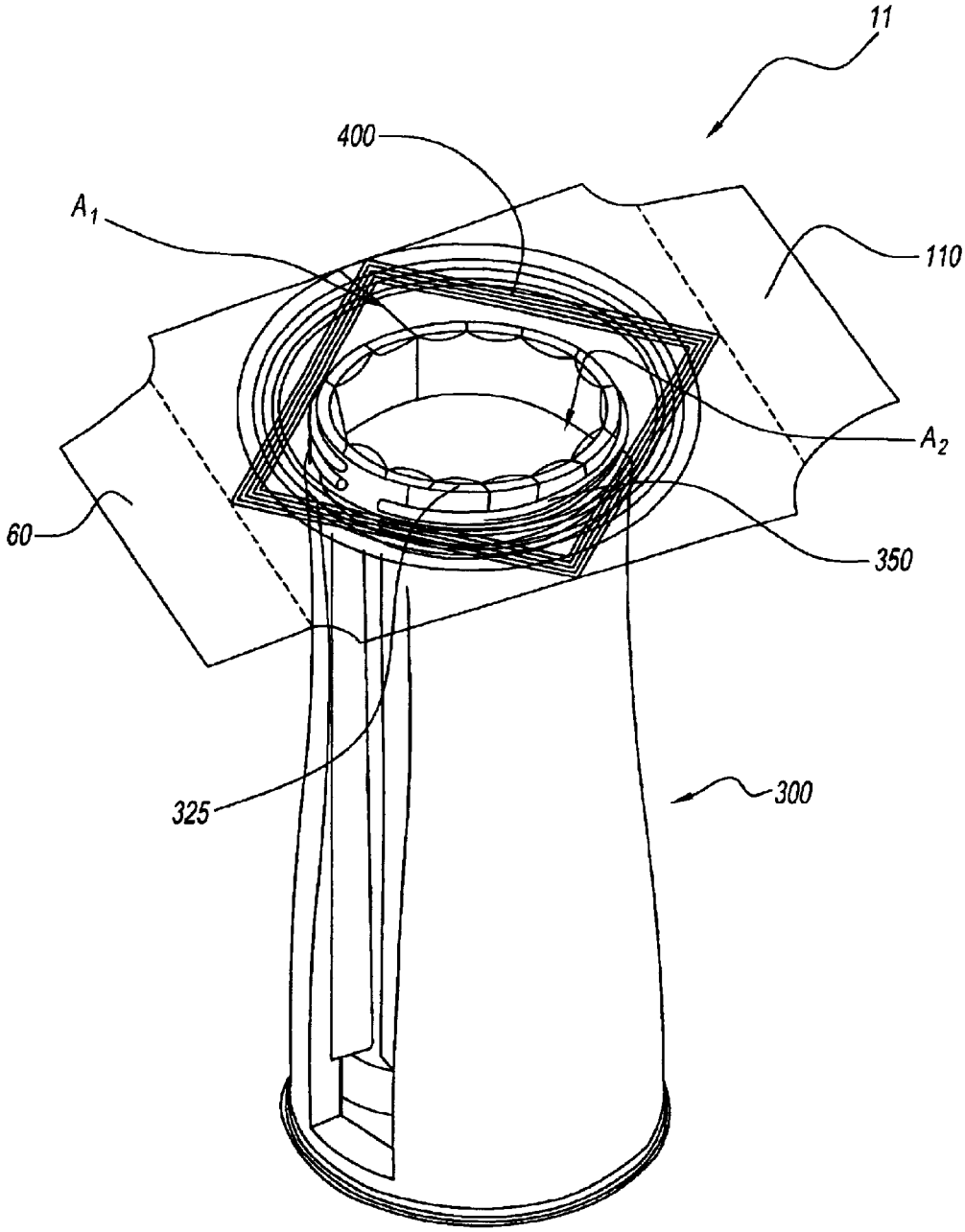
FIG. 6 is a perspective view of the liner of FIG. 5 in an open position and assembled with the holder.

Referring to FIGS. 5 and 6, an alternative embodiment of the liner of the present invention is shown and generally represent by reference numeral 11. Liner 11 has similar features to liner 10, which are represented by the same reference numerals, but liner 11 has an alternative closure member 400.

Closure member 400 has a non-linear shape that traverses upper end 20 of liner 11 to allow for selective sealing of enclosure 40 through use of a series of sealing projection members 410. Closure member 400 has an inverted V-like shape. The inverted V-like shape of closure member 400 provides for an inner cross-sectional area $A_1$ that is greater than the outer cross-sectional area $A_2$ of rim 325 of holder 300 as shown in FIG. 6. Thus, closure member 400 can be easily folded over the rim 325 and assembled with the holder 300.

While the preferred embodiment and the alternative embodiment have non-linear closure members 200, 400 that are semi-circular and V-like in shape, respectively, the present invention contemplates the use of closure members that when in a fully opened position provide a greater cross-sectional area than does a closure member that is horizontally or laterally disposed across the liner. As can be seen in FIGS. 1 and 5, each of the liners 10, 11 have traverse axes T (only one of which is shown) across the width of the to or upper portions 20 of the liners, respectively, that are each perpendicular to the longitudinal axis of the liners. The non-linear shapes of closure members 200, 400 cause the closure members to be distanced from, or non-colinear with, all of the traverse axes T along a substantial portion of the axes or width of the upper portion, but allow the closure members to cross at least one of the axes at points $T_1$ and $T_2$. Thus, for any traverse axis T chosen for liners 10, 11, the closure members 200, 400 will be non-colinear with the chosen axis.

Figure 7:
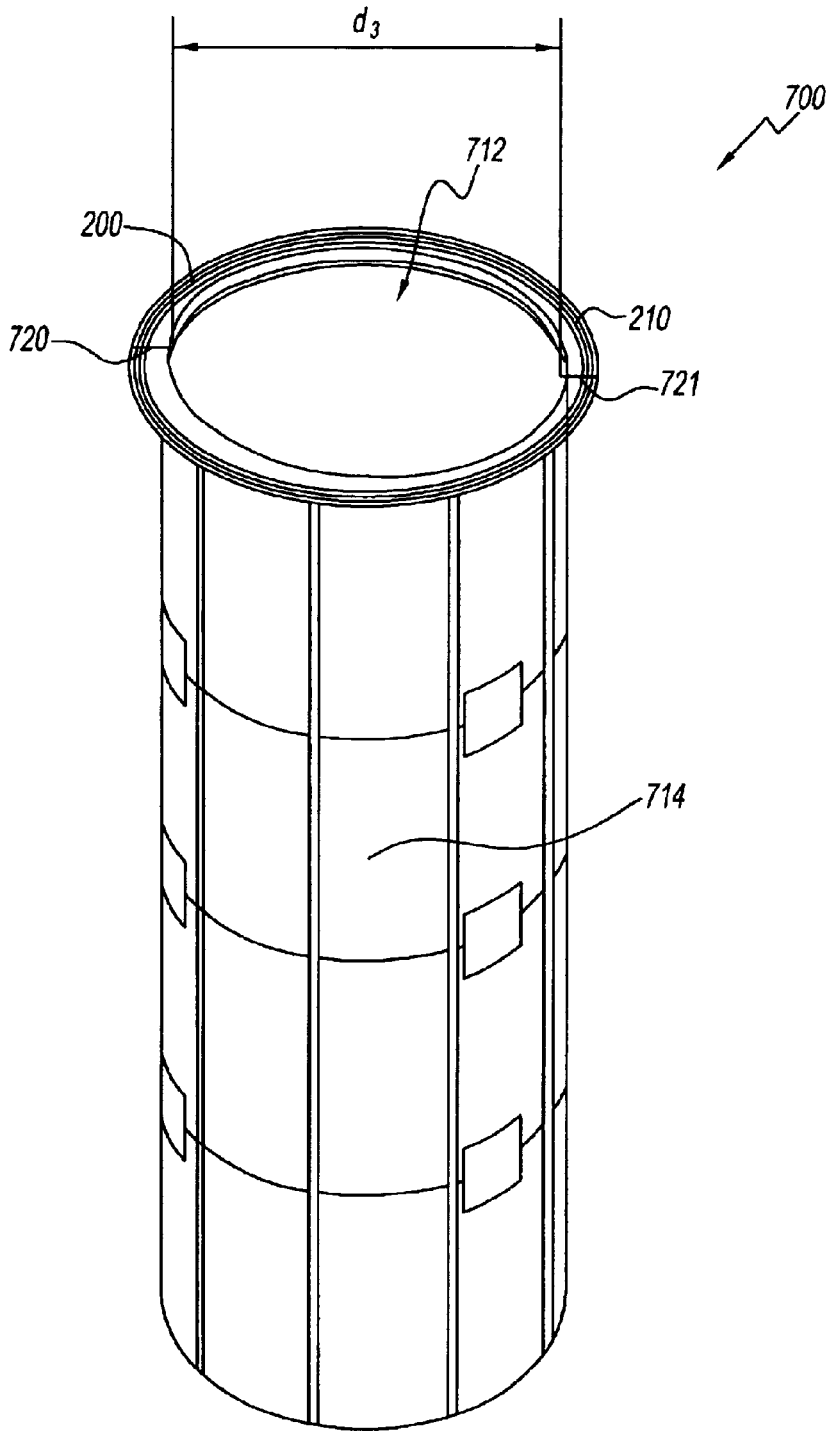
FIG. 7 is a perspective view of another alternative embodiment of a resealable liner of the present invention with the closure member of FIG. 1 in an open position.

Referring to FIG. 7, there is shown another alternative embodiment of a resealable nurser liner generally represented by reference numeral 700. The nurser liner 700 comprises a generally cylindrical enclosure or sack having an open end 712 and a liner body 714. Preferably, liner 700 has a slight downward taper away from open end 712.

Liner 700 has the non-linear closure member 200, as described above with respect to FIGS. 1 through 3, to selectively close the open end 712 and seal the liner. However, the present invention contemplates the use of other selectively sealable members, including linear and non-linear sealing members, for the sealing of liner 700.

Closure member 200 is secured to liner body 714 about the entire circumference of open end 712. Closure member 200 is preferably harder and more resilient than the liner body 714. This facilitates use of the liner 700, including maintaining the liner in an opened position when desired.

Closure member 200 bends along creases 720, 721 to selectively seal the liner 700. Liner body 714 can have an inner diameter $d_3$ greater than the outer diameter $d_2$ of the rim 325 of the holder 300 shown in FIG. 2. This facilitates assembly of closure member 200 over rim 325 when the liner body 714 is disposed in the holder 300 by allowing the closure member to easily pass over the holder rim 325. Liner body 714 can also have a larger downward taper so that inner diameter $d_3$ of closure member 200 is greater than the outer diameter $d_2$ of the rim 325 while most of liner body 714 has a diameter that is approximately equal to the inner diameter of the holder 300 (not shown).

Liner body 714 preferably has a substantially smooth surface, and more preferably does not have heat-sealing longitudinally along its cylindrical sidewall. If a tubular sleeve is used for a portion of liner body 714, then a bottom wall (not shown) can be heat-sealed (or other securing method utilized) to enclose the bottom end of the liner body while closure member 200 is heat-sealed (or other securing method utilized) about liner open end 712. Liner 700 can also incorporate the features described above with respect to liners 10, 11 of FIGS. 1 through 6, such as, for example, first and second tabs 60, 110.

Figure 8:
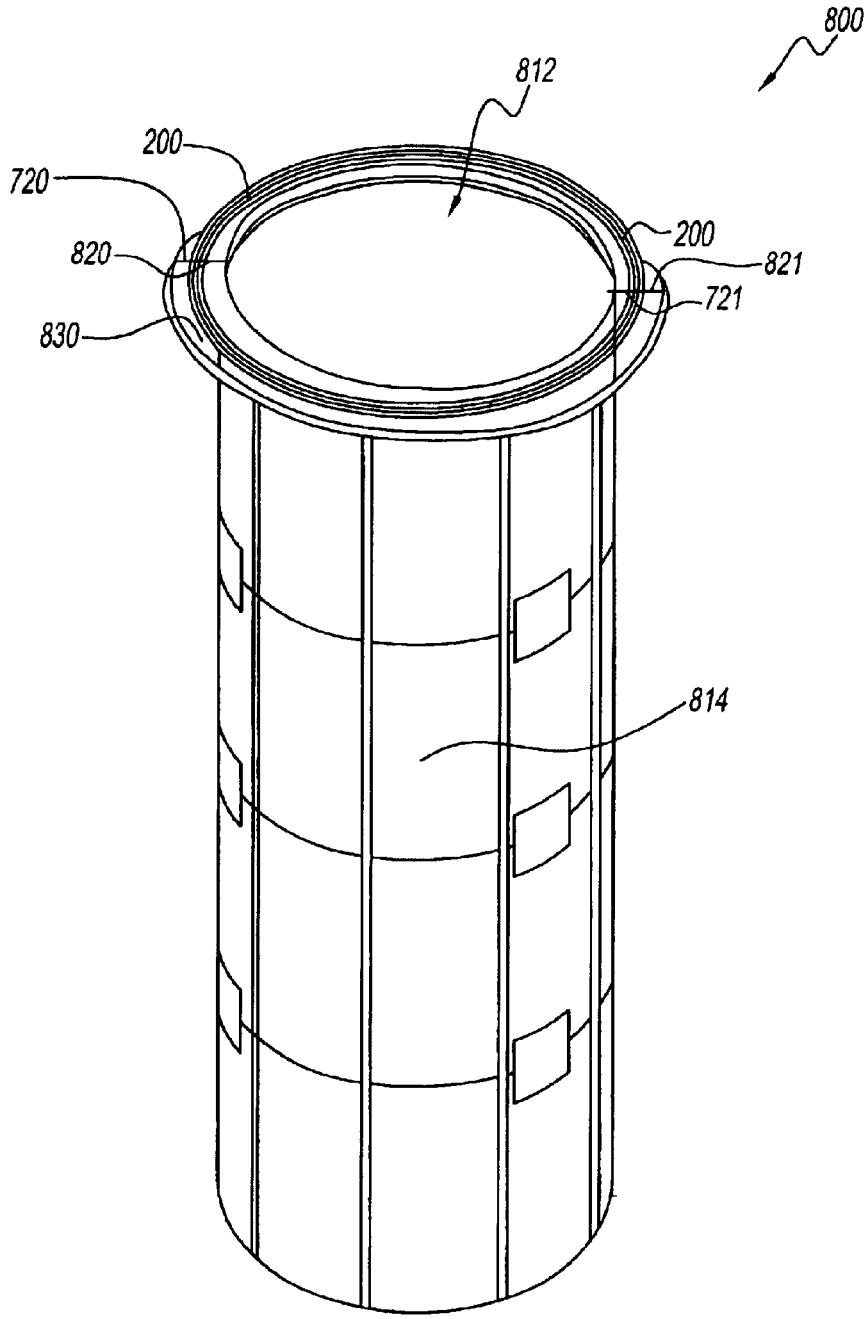
FIG. 8 is a perspective view of another alternative embodiment of a resealable liner of the present invention with the closure member of FIG. 1 in an open position.
Figure 9:
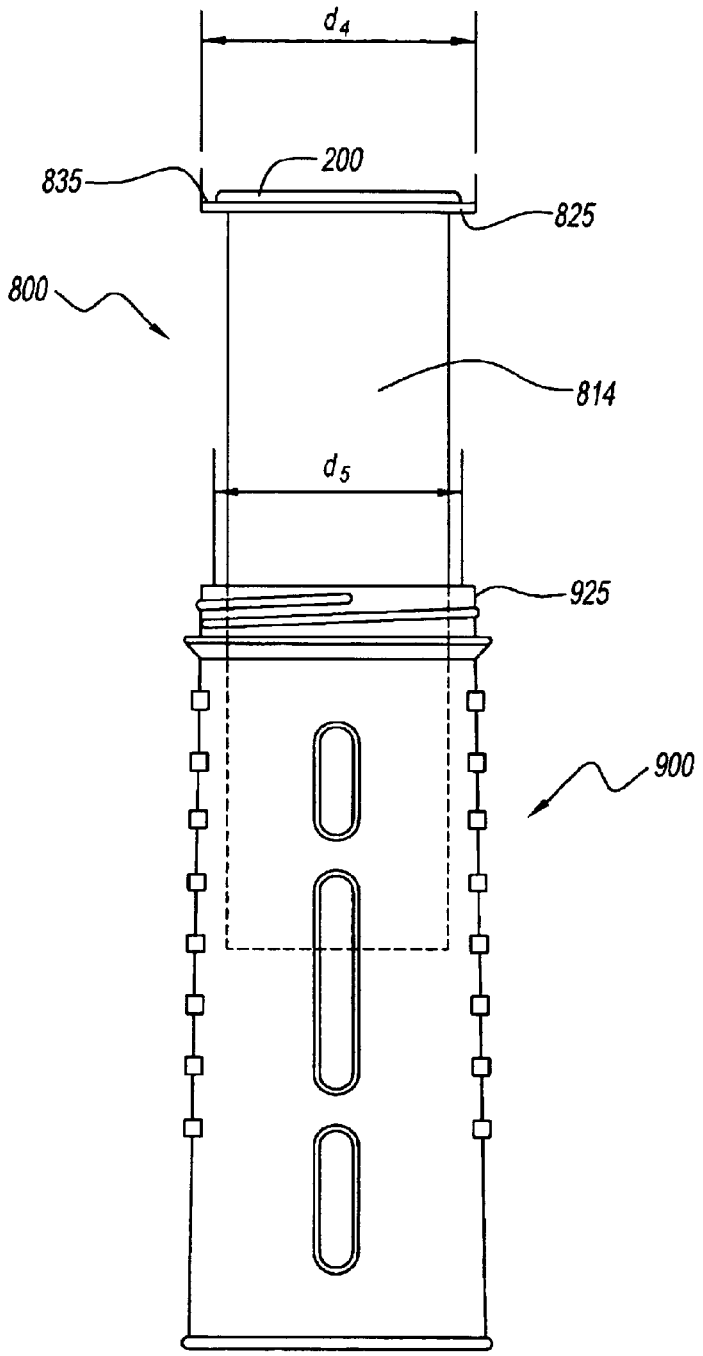
FIG. 9 is an exploded front view of the liner of FIG. 8 partially assembled with a holder.

Referring to FIGS. 8 and 9, there is shown another alternative embodiment of a resealable nurser liner generally represented by reference numeral 800. The nurser liner 800 comprises a generally cylindrical enclosure or sack having an open end 812 and a liner body 814. Preferably, liner 800 has a slight downward taper away from open end 812.

The open end 812 of liner 800 has a resilient flange or rim 830 extending outwardly along its entire circumference. The liner rim 830 is preferably rigid enough to support the weight of fluid contained in liner 800 when mounted in a liner holder 900, as shown in FIG. 9, and held in place by a nipple ring or other securing structure (not shown) against the upper surface of holder rim 925 of the holder. This can be achieved by a combination of proper liner rim thickness and material selection. The liner rim 830 can preferably bend along creases 820, 821 to selectively seal the liner 800, as will be described later.

Liner 800 has the non-linear closure member 200, as described above with respect to FIGS. 1 through 3, to selectively close the open end 812 and seal the liner. However, the present invention contemplates the use of other selectively sealable members, including linear and non-linear sealing members, for the sealing of liner 800.

Closure member 200 can be secured to liner rim 830. Closure member 200 can be heat sealed along the upper surface of the liner rim 830 or other securing methods can be utilized. Closure member 200 can also be secured along the inner periphery or portion of the upper surface of liner rim 830 to leave a flat engagement surface 835 exposed for abutment with the nipple ring or other securing structure (not shown). Closure member 200 bends along creases 720, 721 while liner rim 830 bends along creases 820, 821 to selectively seal the liner 800. Liner rim 830 has an outer diameter $d_4$ that is greater than the inner diameter $d_5$ of the holder rim 925 so that the lower surface 825 of the liner rim can be seated upon the holder rim to hold the liner 800 in place.

Alternatively, liner rim 830 can be separately disposed from closure member 200, such as, for example, above the liner rim and secured to a portion of the liner body 814 that extends above the liner rim (not shown). The liner rim 830 would allow for seating the liner 800 in the holder 900 while the closure member would selectively seal the liner 800 when desired.

The invention having been thus described with particular reference to the preferred forms thereof, it will be obvious that various changes and modifications may be made therein without departing from the spirit and scope of the invention as defined in the appended claims.

What is claimed is:

1. A flexible nurser liner usable with a holder having a rim defining an open end, the liner comprising:

a body having a periphery with an opening and with a remainder of the periphery being a sealed periphery, said body defining an inner volume; and a closure member being selectively resealable and traversing said opening for providing selective access to said inner volume, wherein said closure member has a non-linear shape, and wherein said closure member has a semi-circular shape.

2. The liner of claim 1, wherein said semi-circular shape is upwardly convex.

3. The liner of claim 1, wherein said body has first and second panels with the same size and shape.

4. The liner of claim 3, wherein said first and second panels are heat-sealed along said sealed periphery.

5. The liner of claim 3, wherein each of said first and second panels has a substantially rectangular shape.

6. The liner of claim 5, wherein said first panel has a first tab, wherein said second panel has a second tab, and wherein said first and second tabs are perforated for removal.

7. The liner of claim 6, wherein each of said first and second tabs has a textured surface and a non-textured surface.

8. The liner of claim 1, further comprising an identification area for identifying contents of said inner volume, wherein said closure member partially defines said identification area.

9. The liner of claim 1, further comprising a gusset.

10. The liner of claim 1, wherein said closure member comprises a plurality of projection members.

11. A nurser liner for use with a holder having an opening, the liner comprising:

a liner body having an upper portion with an open end, said liner body defining an inner volume;

a rim positioned on said upper portion and extending outwardly from said liner body, said rim being selectively engageable with said holder opening; and a closure member integrally connected with said rim and non-removable therefrom, said closure member traversing said open end of said liner body, wherein said closure member is movable between a first position for providing access to said inner volume and a second position for sealing said inner volume.

12. The liner of claim 11, said rim has an upper surface, and wherein said closure member is positioned along said upper surface.

13. The liner of claim 11, wherein said rim has an upper surface with an inner portion, and wherein said closure member is positioned along said inner portion.

14. The liner of claim 11, wherein said liner body has an elongated cylindrical shape.

15. A flexible nurser liner usable with a holder having an open end, the liner comprising:

a body having a longitudinal axis, a substantially sealed periphery, and a top portion with an opening, said body defining an inner volume, said top portion having traverse axes perpendicular to said longitudinal axis; and a closure member being selectively resealable and traversing said opening for providing selective access to said inner volume, wherein said closure member is integrally connected with said liner body and non-removable therefrom, and wherein said closure member is non-colinear with respect to all of said traverse axes over a substantial portion of said top portion.

16. The liner of claim 15, wherein said closure member has a non-linear shape.

17. The liner of claim 15, wherein said closure member has an arcuate shape.

18. The liner of claim 15, wherein said closure member has a V-like shape.

19. The liner of claim 15, wherein said closure member has an apex.

20. The liner of claim 15, further comprising an identification area for identifying contents of said inner volume, wherein said closure member partially defines said identification area.

21. The liner of claim 15, wherein said closure member comprises opposing projection members.

22. The liner of claim 15, wherein said closure member comprises a zipper.

23. An infant feeding assembly comprising:

a flexible liner having a body and a closure member, said body having a periphery with an opening and a remainder of the periphery being a sealed periphery, said body defining a first volume, said closure member being selectively resealable and traversing said opening for providing selective access to said first volume; and a holder having an open end and defining a second volume, wherein said flexible liner is positioned in said second volume, wherein said closure member has a non-linear shape, and wherein said closure member has a V-like shape extending substantially across said body.

24. The assembly of claim 23, wherein said V-like shape is inverted.

25. The assembly of claim 23, wherein said body has first and second panels with the same size and shape.

26. The assembly of claim 25, wherein said first and second panels are heat-sealed along said sealed periphery.

27. The assembly of claim 25, wherein each of said first and second panels has a substantially rectangular shape.

28. The assembly of claim 27, wherein said first panel has a first tab, wherein said second panel has a second tab, and wherein said first and second tabs are perforated for removal.

29. The assembly of claim 28, wherein each of said first and second tabs has a textured surface and a non-textured surface.

30. The assembly of claim 23, wherein said flexible liner has an identification area for identifying contents of said first volume, and wherein said closure member partially defines said identification area.

31. The assembly of claim 23, wherein said flexible liner has a gusset.

32. The assembly of claim 23, wherein said closure member comprises a plurality of projection members.

33. An infant feeding assembly comprising:

a flexible liner having a body and a closure member, said body having a periphery with an opening and a remainder of the periphery being a sealed periphery, said body defining a first volume, said closure member being resealable and traversing said opening, said closure member movable between first and second positions, said first position allowing access through said opening and said second position sealing said opening, said closure member having an inner cross-sectional area when in said first position; and a holder having an open end with an outer cross-sectional area, said holder defining a second volume, wherein said flexible liner is positioned in said second volume, wherein said inner cross-sectional area is greater than said outer cross-sectional area so that said closure member can slide past said open end, wherein said flexible liner has an identification area for identifying contents of said first volume, and wherein said closure member partially defines said identification area.

34. The assembly of claim 33, wherein said closure member has a non-linear shape.

35. The assembly of claim 33, wherein said closure member has a semi-circular shape.

36. The assembly of claim 35, wherein said semi-circular shape is upwardly convex.

37. The assembly of claim 33, wherein said closure member has a V-like shape.

38. The assembly of claim 37, wherein said V-like shape is inverted.

39. The assembly of claim 33, wherein said body has first and second panels with the same size and shape.

40. The assembly of claim 29, wherein said first and second panels are heat-sealed along said sealed periphery.

41. The assembly of claim 39, wherein said first and second panels have a substantially rectangular shape.

42. The assembly of claim 39, wherein said first panel has a first tab, wherein said second panel has a second tab, and wherein said first and second tabs are perforated for removal.

43. The assembly of claim 42, wherein each of said first and second tabs has a textured surface and a non-textured surface.

44. The assembly of claim 33, wherein said flexible liner has a gusset.

45. The assembly of claim 33, wherein said closure member comprises a plurality of projection members.

46. An infant feeding assembly comprising:

a nurser liner having a liner body with a rim and a closure member, said liner body having an upper portion with an open end, said liner body defining a first volume, said rim being positioned on said upper portion and extending outwardly from said liner body; and a holder having an opening and defining a second volume, wherein said closure member is integrally connected with said liner body and non-removable therefrom, said closure member traversing said open end of said liner body, wherein said closure member is movable between a first position for providing access to said inner volume and a second position for sealing said inner volume, and wherein said rim selectively engages with said holder opening for positioning said nurser liner in said second volume.

47. The assembly of claim 46, wherein said rim has an upper surface, and wherein said closure member is along said upper surface.

48. The assembly of claim 46, wherein said rim has an upper surface with an inner portion, and wherein said closure member is along said inner portion.

49. The assembly of claim 46, wherein said nurser liner has a substantially cylindrical shape.

50. An infant feeding assembly comprising:

a nurser liner having a liner body and a closure member, wherein said liner body has a longitudinal axis, a substantially sealed periphery, and a top portion with an opening, said liner body defining an inner volume, said top portion having traverse axes perpendicular to said longitudinal axis, said closure member being selectively resealable and traversing said opening for providing selective access to said inner volume, said closure member being integrally connected with said liner body and non-removable therefrom, said closure member being non-colinear traverse axes over a substantial portion of said top portion; and a holder having a body defining a second volume and a rim defining an open end, said top portion of said liner body selectively engaging with said rim of said holder for positioning said nurser liner with said second volume.

51. The assembly of claim 50, wherein said closure member has a non-linear shape.

52. The assembly of claim 50, wherein said closure member has an arcuate shape.

53. The assembly of claim 50, wherein said closure member has a V-like shape.

54. The assembly of claim 50, wherein said closure member has an apex.

55. The assembly of claim 50, further comprising an identification area for identifying contents of said inner volume, wherein said closure member partially defines said identification area.

56. The assembly of claim 50, wherein said closure member comprises opposing projection members.

57. The assembly of claim 50, wherein said closure member comprises a zipper.

* * * * *